US009355520B2

(12) United States Patent
Luciano, Jr. et al.

(10) Patent No.: US 9,355,520 B2
(45) **Date of Patent: *May 31, 2016**

(54) APPARENT SKILL GAMES FOR USE WITH PREDETERMINED OUTCOMES

(71) Applicant: Bally Gaming, Inc., Las Vegas, NV (US)

(72) Inventors: Robert A. Luciano, Jr., Reno, NV (US); Loren Nelson, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/266,605

(22) Filed: Apr. 30, 2014

(65) Prior Publication Data

US 2014/0235309 A1 Aug. 21, 2014

Related U.S. Application Data

(63) Continuation of application No. 11/681,126, filed on Mar. 1, 2007, now Pat. No. 8,814,666, which is a continuation of application No. 10/633,081, filed on Aug. 1, 2003, now abandoned, said application No. 11/681,126 is a continuation-in-part of application No. 11/550,349, filed on Oct. 17, 2006, now Pat. No. 7,874,903, which is a continuation of application No. 10/242,254, filed on Sep. 12, 2002, now Pat. No. 7,128,645, which is a continuation-in-part of application No. 09/912,797, filed on Jul. 23, 2001, now Pat. No. 6,749,500.

(60) Provisional application No. 60/400,644, filed on Aug. 3, 2002.

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3293* (2013.01)

(58) Field of Classification Search
CPC ..... G07F 17/3244
See application file for complete search history.

(56) References Cited

U.S. PATENT DOCUMENTS 4,582,324 A 4/1986 Koza et al.
5,019,973 A 5/1991 Wilcox et al.

(Continued)

*Primary Examiner* — Steve Rowland
(74) *Attorney, Agent, or Firm* — David Bremer; Brooke Quist; Marvin Hein

(57) ABSTRACT

A gaming system having a game outcome generator separate from a gaming device, where the gaming device is wirelessly connected to the game outcome generator and, upon a game play request from a player, generates a request for a game play result. The game outcome generator generates a specific game outcome (won amount if the game play is a winning result, or a no-win, 0-value result) and sends it back to the gaming device. The gaming device uses the predetermined result to mimic or simulate a skill based game. The skill based game is designed to play just like an actual skill based game, which may result in poor players not getting the game to a state that has an equivalent value as that which is supposed to be awarded (equal to the predetermined game play). Each game includes a final game event, consistent with the game just played, which enables the game to make up any difference between the actual result of the skill based and the predetermined amount. This preserves the look and feel of the skill based game while allowing the game to award the player the total amount of the predetermined award.

11 Claims, 4 Drawing Sheets

(56) References Cited

U.S. PATENT DOCUMENTS

| | | | |
|---|---|---|---|
| 5,308,065 | A | 5/1994 | Bridgeman et al. |
| 5,489,101 | A | 2/1996 | Moody |
| 5,542,669 | A | 8/1996 | Charron et al. |
| 5,833,536 | A | 11/1998 | Davids et al. |
| 5,851,148 | A | 12/1998 | Brune et al. |
| 5,853,325 | A | 12/1998 | Kadlic |
| 5,882,259 | A | 3/1999 | Holmes, Jr. et al. |
| 5,971,849 | A | 10/1999 | Falciglia |
| 6,001,016 | A | 12/1999 | Walker et al. |
| 6,062,981 | A | 5/2000 | Luciano, Jr. |
| 6,098,985 | A | 8/2000 | Moody |
| 6,110,040 | A | 8/2000 | Sanduski et al. |
| 6,117,009 | A | 9/2000 | Yoseloff |
| 6,131,907 | A | 10/2000 | Nucifora et al. |
| 6,132,311 | A | 10/2000 | Williams |
| 6,146,271 | A | 11/2000 | Kadlic |
| 6,149,521 | A | 11/2000 | Sanduski |
| 6,227,969 | B1 | 5/2001 | Yoseloff |
| 6,257,979 | B1 | 7/2001 | Walker et al. |
| 6,299,170 | B1 | 10/2001 | Yoseloff |
| 6,343,989 | B1 | 2/2002 | Wood et al. |
| 6,398,645 | B1 | 6/2002 | Yoseloff |
| 6,443,456 | B1 | 9/2002 | Gajor |
| 6,537,150 | B1 | 3/2003 | Luciano et al. |
| 6,554,283 | B2 | 4/2003 | Vancura et al. |
| 6,572,473 | B1 | 6/2003 | Baerlocher |
| 6,604,998 | B1 | 8/2003 | Singer et al. |
| 6,666,765 | B2 | 12/2003 | Vancura |
| 6,749,500 | B1 | 6/2004 | Nelson et al. |
| 7,112,133 | B2 | 9/2006 | Lyons |
| 2002/0034974 | A1 | 3/2002 | Wood et al. |
| 2002/0049082 | A1 | 4/2002 | Bansemer et al. |
| 2002/0077165 | A1 | 6/2002 | Bansemer et al. |
| 2002/0107063 | A1 | 8/2002 | Ashley et al. |
| 2002/0187827 | A1 | 12/2002 | Blankstein |
| 2003/0003980 | A1 | 1/2003 | Moody |
| 2003/0060276 | A1 | 3/2003 | Walker et al. |

APPARENT SKILL GAMES FOR USE WITH PREDETERMINED OUTCOMES

CROSS-REFERENCE TO RELATED APPLICATIONS

This application is a continuation of U.S. patent application Ser. No. 11/681,126 filed Mar. 1, 2007, which is a continuation of U.S. patent application Ser. No. 10/633,081 filed Aug. 1, 2003, now abandoned, which claims the benefit of U.S. Provisional Application No. 60/400,644 filed Aug. 3, 2002, all of which are herein incorporated by reference in their entirety. U.S. patent application Ser. No. 11/681,126 is also a continuation-in-part of U.S. patent application Ser. No. 11/550,349 filed Oct. 17, 2006, now U.S. Pat. No. 7,874,903, which is a continuation of U.S. patent application Ser. No. 10/242,254 filed Sep. 12, 2002, now U.S. Pat. No. 7,128,645, which is a continuation-in-part of U.S. patent application Ser. No. 09/912,797 filed Jul. 23, 2001, now U.S. Pat. No. 6,749,500, all of which are herein incorporated by reference in their entirety.

BACKGROUND

1. Field of the Invention

This invention pertains generally to gaming systems. More particularly, the present invention relates to a method and apparatus for providing the appearance to players of playing a game requiring some skill, while actually playing a game where the outcome is predetermined before game play begins.

2. The Prior Art

Fixed pool games are well known, often forming the basis of many games used by many state and private lotteries. A fixed pool game is one in which a specified amount of money or prizes (the prizes having calculable monetary equivalents) are distributed into a set of individually purchasable and winnable units, where each individual unit has a known cost, and where the set further includes purchasable units having no prize. Thus, the total amount of prizes, the prize distribution (i.e., the number of prizes at each level), and the total return if all individually purchasable units are sold are known at the game's outset.

The individually purchasable units are typically generated and distributed as tickets. The two most common forms of tickets are pull tab tickets, called pulltabs, and scratch-off tickets, called scratchers. Pull tab tickets are typically constructed from paper of various thickness, having two layers. The first layer has some type of indication of the purchasers' winnings, if any, and the second layer covers the first. The second layer is typically glued to the first layer around three edges, covering the results. The fourth edge typically has a small tab, allowing the purchaser to grab hold of it. The tab, upon being pulled, pulls the layers apart and reveals the purchasers' winnings, if any. Scratchers use an opaque material that covers portions of the ticket, where the covered portions have the predetermined results on them. The purchaser scrapes off the opaque material, revealing any winnings.

The distribution of the total winnings, coupled with the cost of each individually purchasable unit, is determined by those making up the game. The exact mechanics and mathematics of each game pool depends on the goals of the issuer, including the target play audience (how much to charge per purchasable unit or ticket or play), the desired return on investment, and size of the pool, as well as other considerations as are well known in the art. The tickets (individually purchasable units) for the entire game are then printed and distributed, usually organized into decks with different decks sold to different locations. Players, by purchasing a ticket, are buying one individually purchasable unit from the overall ticket or game event pool.

This may be referred to as a fixed-pool lottery, meaning there is a fixed pool of tickets (or results) having a predetermined number of winners and losers, and a purchaser takes a chance on getting a winning result by entering the "lottery", meaning taking the chance they will buy a winning ticket from the pool.

To make the results more interesting to a player, fixed-pool lottery based games have been recently been displayed in many ways. One particular representation is as a poker hand, attempting to mimic actual poker play. The player bets a certain amount to play the game. This corresponds to an individually purchasable unit for the lottery being used. The game will typically get the result of a random drawing from a central server or location having several operating pools. The result is sent back to the game machine. The game machine then represents the results in as a game.

Up to the present time, game machines using fixed-pool lotteries which have attempted to represent the predetermined winning amount by mimicking poker and other games involving some skill component have had significant limitations. For example, if the predetermined win is presented in the form of poker, the prior art machines would present the player with a 5 cards (mimicking a hand). The player then indicates which cards to hold, with the rest being "discarded". If the player is either not a good poker player or is going for long odds, it is often the case that the discarded cards were needed to make up the predetermined winning hand For example, suppose the predetermined award required the player to end up with a full house and the player's initial hand had two pair. If the player discards one from pair, leaving three unrelated cards, a full house cannot be created with the next "draw". The prior art game overrides the player's hold choices and discards the "correct" cards, resulting in a new hand having a full house.

The action of overriding a player's choices completely ruins the intended purpose of the game, which is to produce the illusion of true skill or partial-skill game play. This same thing is true of any game that, if not being used to visually represent predetermined winnings, involve player skill to maximize results. Games appear artificial because the player can tell their choices are being manipulated. As a result, these games have generally attracted minimal player interest.

Thus, there is a need to have skill-based games that can use with predetermined results that can mimic the game play player's experience when they play the game without predetermined results.

BRIEF DESCRIPTION OF THE INVENTION

The present invention discloses a new method and apparatus to allow very realistic display of predetermined gaming results when mimicking what is traditionally a game having player skill. Examples include poker, "battleship" style games, dice games involving keeping certain dice and rolling others such as Yahtzee®, and similar games. Unlike previous games which overrode or restricted a player's choice of play with respect to some actions taken by the player, the present invention allows the player to make any play or allowable interactions of the specific skill game, yet still resulting in a net payout of a predetermined amount.

In one embodiment using a game play based on five card draw, the allowable interactions are made up of choosing which cards to hold and which to discard. If a player makes poor decisions, or tries to play a long shot (as if they were playing real poker, such as trying to fill an inside straight), the result can be a set of held cards that no longer allows the game to represent the predetermined winning amount, regardless of what cards are used to replace those that were discarded. In card games the present invention embodies the use of a special card illustrated on the games display called a bonus card or a match card. The bonus card is a card that is not part of the player's hand (the "in-hand" set of cards); it is under the control of the gaming machine (player terminal). The bonus card appears to a player like a randomly drawn card originating from another deck of cards, where a bonus is won if the apparently randomly drawn card matches an in hand card to which it is associated. "Associated" is explained further below, but means there is one of the in-hand cards that is somehow visually connected to the bonus card. If the two cards are shown as matching (in one embodiment "matching" means having the same suit and value) a bonus award is made.

Other embodiments of the present invention include the possible use of games in a gaming machine such as a dice game where one or dice can be "held" and the other dice rolled to try and create a desired pattern (e.g., all 6's). Just like a card game requiring a player to make a decision on holding cards, a player can hold dice that will result in the gaming machine being unable to award the predetermined outcome. In order to keep realistic play, there is a bonus die throw after the regular throw to enable any missing awards to be given to a player. This is another example of using a final post-play game event, using the final game state, that enables the gaming machine to award the player the predetermined play amount.

Another example of a type of game readily adaptable to the present invention are games based on "finding" items on grids by indicating grid indicators. The most popularly known version of this game involves a grid over land and sea pictures. One player calls out a grid number, and whatever is on that grid is either damaged or destroyed. Players alternate calling grid numbers. The first player to destroy the other player's soldiers, equipment, ships, etc., wins the game. Alternately the first player to call out a series of winning positions (gold bricks, etc.) wins the game. When used as a game in a gaming jurisdiction requiring predetermined game results (i.e., the gaming machine does not determine what the player's winning are—the winnings are given to the gaming machine), the same issue arises—a player can make grid-call decisions that don't allow for the full amount of points to be awarded. To solve the problem in a realistic manner and to fully enable realistic play, a final round was created where a player is given a choice of something to touch or pick having an unknown value; the player picks one of the items and a number is revealed. This number represents any further amount (or 0, in some cases) that must be given to a player as determined by the predetermined game amount.

Note that the present invention may be used while a player is playing either

DETAILED DESCRIPTION OF THE PREFERRED EMBODIMENTS

Figure 1:
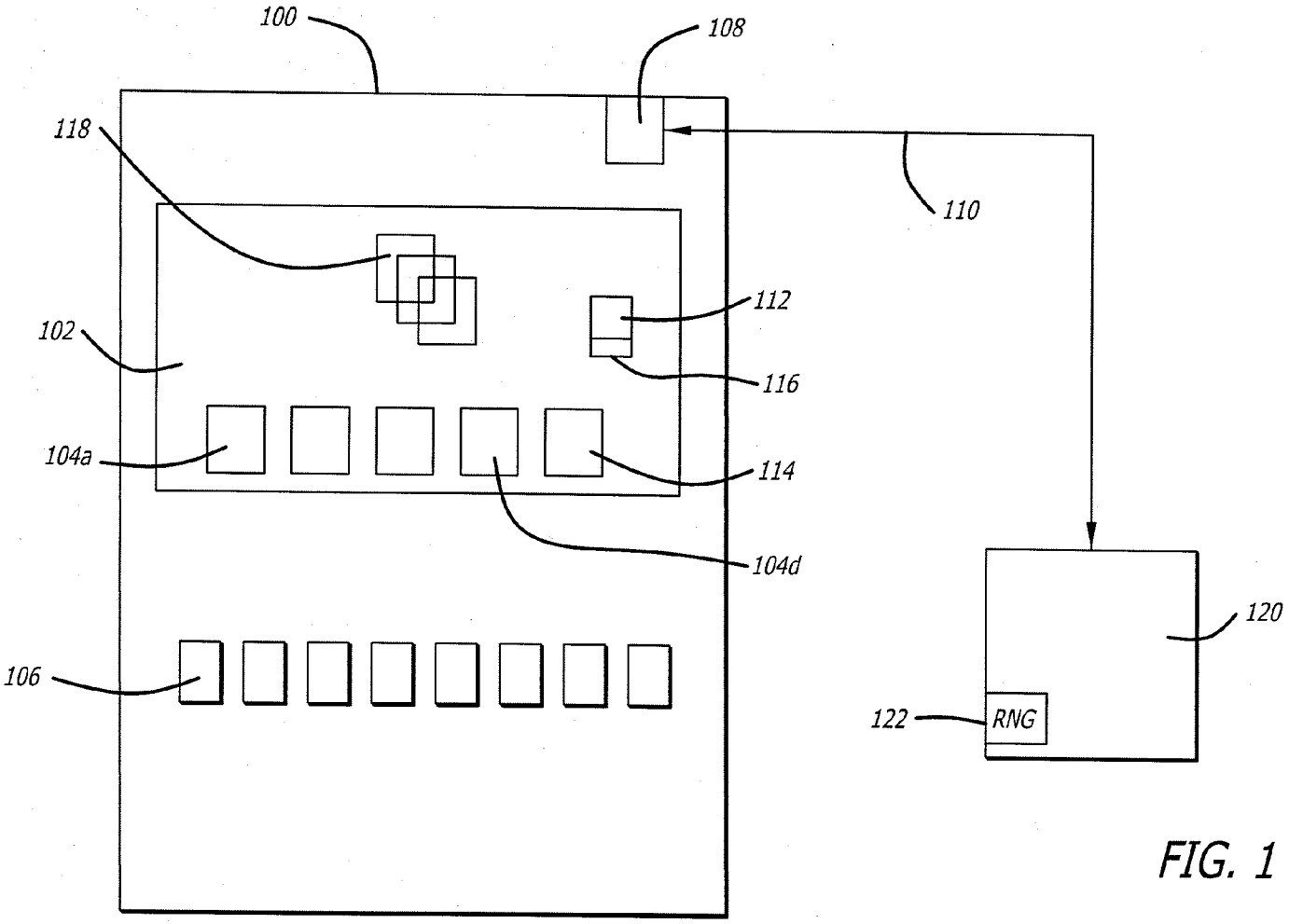
FIG. 1 is a functional block diagram of an example game device in accordance with the present invention.

Persons of ordinary skill in the art will realize that the following description of the present invention is illustrative only and not in any way limiting. Other embodiments of the invention will readily suggest themselves to such skilled persons having the benefit of this disclosure.

Referring to the drawings, for illustrative purposes the present invention is shown embodied in FIGS. 1 through 4. It will be appreciated that the apparatus may vary as to configuration and as to details of the parts, and that any flow diagrams may vary as to details, partitioning, and the order of the acts, without departing from the inventive concepts disclosed herein.

FIG. 1 shows a game system with an exemplar game device according to the present invention. The gaming system includes at least one central server which acts as a game results generator 120. It is operably connected via network connection 110 (may be wireless, connection 110 can be of any type) to game device 100. Note that game results generator 120 has random number generator 122 operably disposed therein. This is used to help generate individual game play winnings, results, outcomes, etc., while game results generator 120 services game play requests from game machine 100. For each game play request generated by the actions of a player at game device 100, game device 100 will generate a game play result request and send it to game result generator 120. Game results generator 120 will generate a game outcome of some kind (points, cash, prize, etc.) in whatever form is consistent with the installation. Each particular game play result, which may be a winning dollar amount, a prize, or any other form of winnings, can include a no-win or 0-win result if there was nothing won for that particular game play. Whatever is generated, it is sent to the gaming machine that made the game play request, along with other information such as a game play identifier and such, which would identify that particular game play result in a central database. The gaming machine then uses the already determined game play result (a predetermined game outcome or result, as far as the gaming machine is concerned) to create a simulated game of skill or partial skill for the player.

The game device has a cabinet 100 enclosing a video display 102 and a set of standard game play buttons shown generally as buttons 106. The game device also comprises the internal hardware and software needed for gaming devices, including at least one processor, dynamic memory, non-volatile memory, system support circuitry such that an embedded operating system will run properly, and I/O connections including interfaces to the various player interfaces such as play buttons 106 and video 102 output, and an interface to an external network connection shown as a network interface board 108. Also included is the software needed to implement the specific game. The internals are not illustrated. Network interface 108 interfaces with a network 110.

The present invention discloses a new way of showing apparent-skill game play in a predetermined environment (meaning the gaming machine does not determine what a player will win, nor does the player, rather the amount to be awarded to a player is provided to the gaming machine before any game play sequences start). For the purposes of this disclosure, "apparent skill game" or "apparent partial skill game" will be used to mean any game that, when played by a player outside the context of having a predetermined outcome, has different results depending on how the player plays. Partial skill games differ from skill games in that some element of chance remains, coupled with some element of skill. Classic examples of pure-skill games are Nintendo® or Sony PlayStation® games. If the player does nothing, the game does not advance (alternatively the player "crashes", "dies", or the game otherwise stops). Other games are part skill, part chance. Classic partial-skill games include any card games where play involves some random draw, and some skilled response (typically poker), and some dice games like Yahtzee®. Note that in these games, it is still the player's skill that determines at least part of the overall outcome (i.e., given the same cards a good poker player will win more than a bad poker player). Games where the player plays no part (no-skill games) include the classic Nevada-style slot machines—the game outcome is determined by pure chance, and is outside the player's ability to influence.

"Apparent skill games" means any pure-skill game or partial-skill game where the amount to be won by a player is actually predetermined (known before game play starts), thus constraining the required outcome. The ideal apparent skill game is one that looks to the player just like the full-skill or partial-skill game on which it is based, but which still gives out the required winning amounts regardless of actual player skill.

An example of an apparent skill game is shown on a gaming machine in FIG. 1. It is based on five card poker with a single drawn. It was discovered that by using an addition specially designated card, shown as card 112, over and above the cards that comprise a traditional poker hand, completely realistic play may be achieved. The additional card will be referred to as a "bonus card" for the purposes of this disclosure, and "in-hand" refers to the cards that comprise a poker hand. The actual number of cards in-hand varies depending on the type of poker being played or used. Illustrated is five card draw poker having five cards in-hand, shown as cards 104*a* through 104*d* and card 114. The apparent skill (realistic play to a player) is achieved using predetermined results without regard to any mistakes, bad play, or long shot holds and draws a player may decide to use.

Match card 112 is shown placed above one of the in-hand cards, card 114. In one embodiment, this physical placement corresponds to the card association that indicates which two cards must match if bonus points are to be awarded. Match card 112 is left illustrated on the video screen as an upside down card, only showing the reverse side, until the player is shown a hand, makes hold decisions, and the discarded cards replaced. Simultaneously with, or shortly after, the discards are shown as replaced with "new" cards, match card 112 is shown as turned onto its obverse. In this implementation, match card 112 and the card shown in position 114 must be the same card for a bonus event to occur (these two cards comprise associated cards, indicated by their relative physical position on screen 102). If they show as the same card, a bonus number is displayed in bonus window 116, which is added to the player's overall game credits or score.

As used in this disclosure, "same card" is defined to mean that two cards have the same suit and value showing on their obverse sides. "Matched card", "matching card", and "match card" are used in this disclosure to mean two cards having the same suit, the same value, the same suit and value, or being two "related cards." "Related cards" is defined to mean two cards related by explicit rules of the game other than suit and face value. An example of "related cards" is a game where a bonus is awarded if the bonus card has twice the value of the inhand card, such as the bonus being a ten of diamonds and the in-hand card to which it is associated is a five of diamonds. Thus, examples of "matched cards" includes "same cards" such as both cards being a queen of diamond, same suit cards such as a two and a ten of clubs, same value cards such as a three of spades and a three of hearts, and any two cards related by the rules of a particular game. Each particular game implementation will make clear which cards match; the present invention works equally well with all these definitions.

In one preferred embodiment, match card 112 is implemented as an image (on a video screen) having a different size, physically, from the in-hand cards 104 through 104*d* and 114. This helps distinguish the two types of cards, visually, for the player. Match card 112 is designed to be visually suggestive of a random card drawn from a different deck than the in-hand cards, where bonus points are awarded if the "randomly drawn" match card 112 and the card in position 114 are the same card.

A preferred embodiment using five card draw is shown in FIG. 1, however, the present invention is readily used in any of the numerous poker variations used in poker gaming machines, including but not limited to 5 and 7 card stud, Texas Hold'em, the various three-card and more in-hand card games found in some poker variations, and the any of the multi-line and multi-hand poker variations. The present invention is used by having each individual in-hand card set (perhaps represented by a pay line in a card matrix, for example, as well as the traditional line of cards) also be associated with a match card. Note that a single match card may be associated with more than one in-hand card set, although there must be at least one match card associated with each playable in-hand set of cards.

Poker was a single example of a virtually unlimited set of apparent-skill games that enable a player to play a game, where the game results differ depending on the skill of the player, where the amount to be awarded ("won") to the player is predetermined, and where the game enables realistic play by the player by providing a post-game play, post-game event, or post-play adder to the jackpot shown on the screen that enables the total jackpot to reach the amount of the predetermined win.

Another example would be blackjack, where a player may choose to hold or hit and the resulting set of cards (generated using the known predetermined result of the game) is either under (ex: a player holds showing 2 cards totalling 9) or over (ex: a player keeps hitting until they go over 21) what an experienced player would generate in the same situation. Returning to FIG. 1, cards 118 would represent the dealer's hand, and cards 104*a*-104*d* and 114 would represent the player's possible hand (clearly not all card positions would be used in each play). If the player plays badly, thereby not allowing the game to show the amount. It is supposed to award the player because the player either hits or holds when they shouldn't, the "bonus" 112 is used such that it matches one of the cards in the player's hand, allowing the awarding of the remaining award, points, cash, etc., that the player, but for their incorrect play, would have been awarded during regular game play. As can be seen by these examples, using a match card allows game play according the player (without changing any of the player's decisions, even when it will result in a payout that is less than the required, predetermined payout), while also enabling the amount that must be awarded to a player to be awarded.

Figure 2:
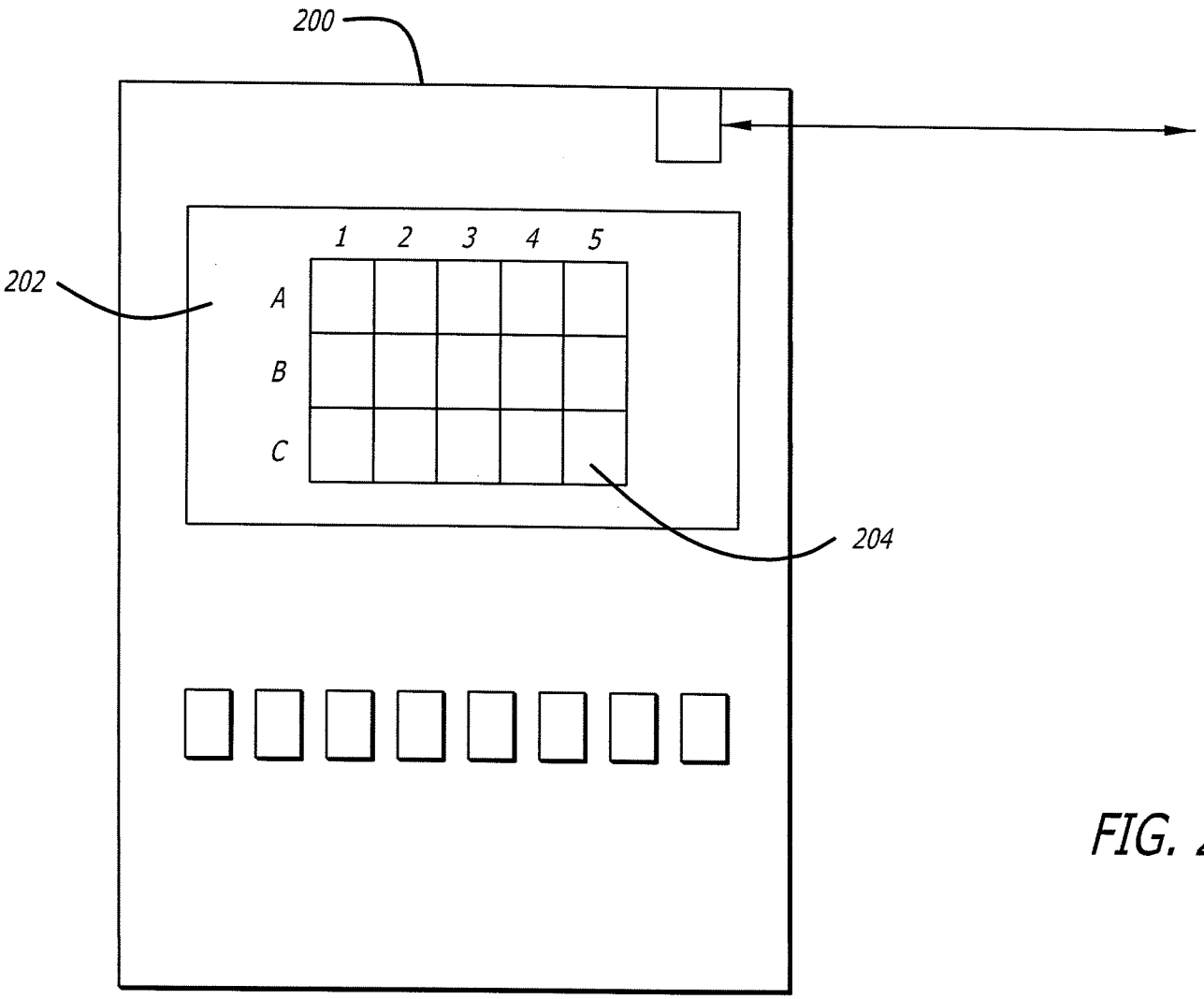
FIG. 2 is a functional block diagram of another game device in accordance with the present invention.

Yet another example is shown in FIG. 2, a game machine 200 having screen 202 with a grid layout 204 on it, enabling grid-style game play. The rest of the machine is similar to the shown and described in FIG. 1. An actual implementation of game 200 would have pretty graphics, etc., to create the right look and feel for the intended game. For example, if the game is to sink ships the background of grid area 204 would look an ocean or lake. The player is given a specified number of shots (illustrated as cannon, torpedoes, rockets, etc.), and the player inputs which grid square to hit. Although in fact predetermined, the game plays like a skill-based game from a player's perspective. The difference is that if the player forces poor shots (i.e., calls out grid areas where a potential target cannot reside due to spatial limitations) such that the total points awarded after the allowed number of shots are taken are not enough to meet the predetermined amount, that amount is taken care of in a next game event that takes place after the player's shots are taken. In one embodiment, the player is shown a second screen with a selection of medals or mystery prizes on it, from which they pick one (a touchscreen). After touching a spot on the screen, the video display makes the touched medal appear to dissolves or move aside showing a number. The number may represent an adder, an amount to be added to the amount already won, or a multiplier, where the amount shown as won is multiplied by the revealed number. In any case, the gaming machine creates the adder or multiplier to end up with the amount of winnings that must be awarded to the player. Note that as far as the player is concerned, the grid-based game played as it would in any uncontrolled situation. No override of any of the player's moves is required; no artificial restrictions on the type of shots is required.

A further embodiment of the present invention (not illustrated) is a dice game involving multiple dice, where a player achieves a certain pattern of dice through multiple throws, and where after each throw a player may keep one or more of the dice just thrown. The patterns include, for example, trying to collect 6 "ones" from 6 dice in three roles. There will be a payout table showing the amount a player wins depending on the dice pattern at the end of the throws. This is similar to poker, where a player may chose the wrong dice to keep at the end of each throw. Over a number of throws, it is possible that the player has ended the game with too few points due to poor "hold" choices. To prevent a forced win on the player by not allowing a player to fully choose which dice to hold at the end of a throw, the present invention provides for an additional play at the end of the game. After the player's last play, the game machine has calculated if the predetermined amount of winnings has already been won, and if not, how much more must be given to a player. The video screen now shows two additional dice; the player touches a button and the dice appear to roll. If the dice come up as a matching number (any number), then the physical area directly behind the paytables for the dice game start lighting up, one after the other (one payline after another). It is designed to give the appearance of rapid initial movement followed by a perceptual slowing down until the sequence of backlit paylines "slows" to a stop, giving the look and feel of randomness by virtue of the gradual slowdown. In fact, the gaming machine has determined which payline (including 0, as the case may be) must be shown as the final backlit payline (the amount will be added to the player's total winnings) to bring the total to the predetermined winning amount. This enables the apparent play of the dice game to precisely mimic what would happen with real dice. As each game is played, it is of course the case that the game machine is enabling the player to arrive at the predetermined amount by having each "throw" result in a desired (by the game machine) set of dice numbers being shown; the game machine also prevents "over-awards" by not showing dice throws that would enable a player to have a payline above the amount of the predetermined award.

Figure 3:
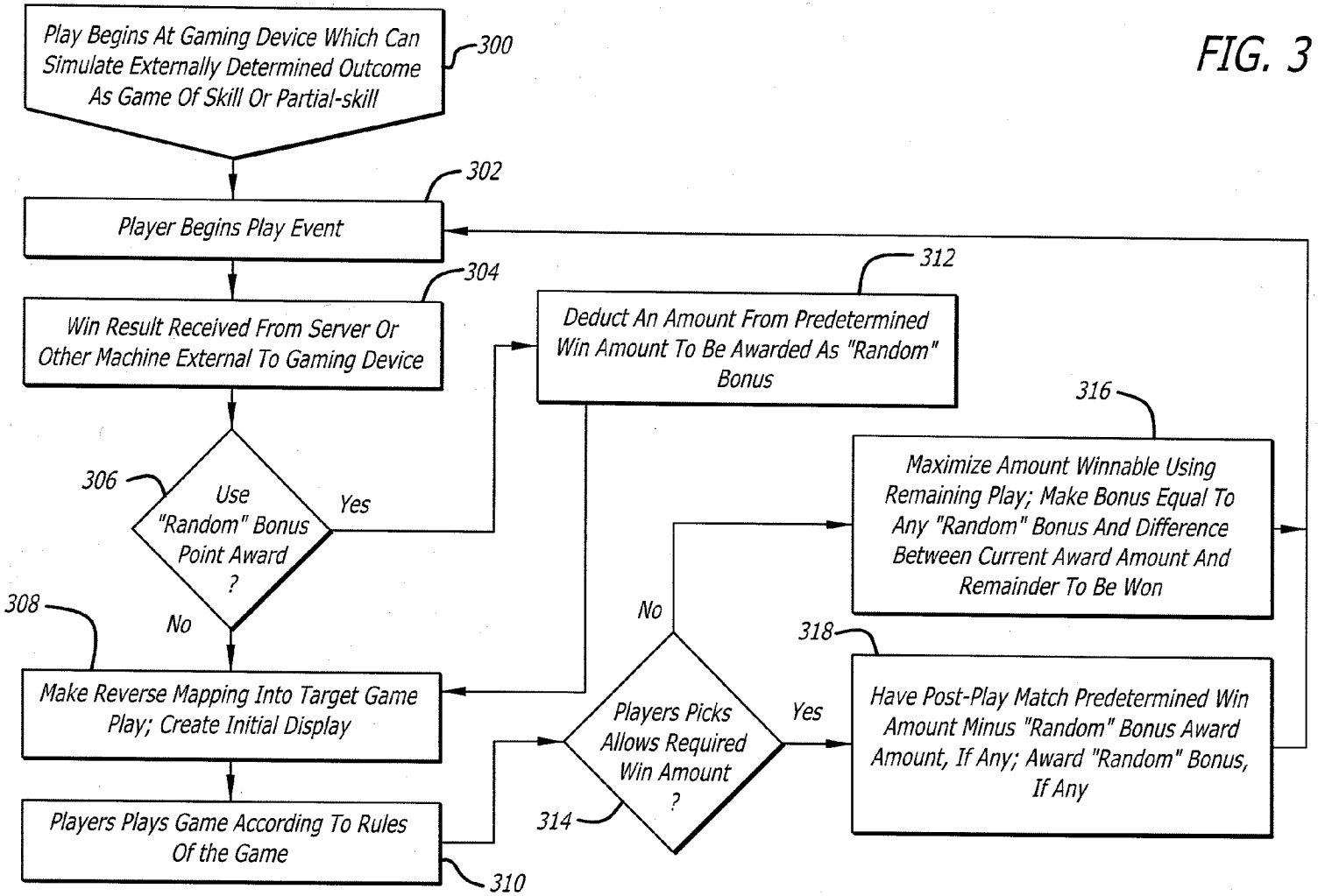
FIG. 3 is a flow diagram illustrating simulated game play in accordance with the present invention.

Referring now to FIG. 3, a method for using a post-play event to create simulated game play having predetermined outcomes while maintaining player choice during game play is shown. A player begins play at a game device where the underlying game results are derived from a fixed-pool lottery, box 300. The player initiates a game play event. Initiating a game play event includes providing some form of remuneration for game play, which is used in this disclosure as any type. It may be either direct (tokens, cash, vouchers, from an EFT transfer, etc., and input to the game by a player) or indirect (an award, credits left on the machine from another player, credits based on some kind of subscription or fixed payment made to a casino or a third party who then reimburses the casino on the back-end, indirect payment made from advertisers, etc.). Any form of payment from any source, direct or indirect, is contemplated as within the scope of the present invention. Continuing with box 302, a game play event is any action or actions (such as choosing bet amounts and then hitting a "play" button) by a player that results in game play to be started. Upon the occurrence of a game initiation event, box 302 is left and box 304 entered.

The actions corresponding to box 304 are the game device communicating to a backend machine on which an applicable fixed-pool game (having a predetermined set of results) is being run. The game device appropriately signals the backend system for a game result, and a result is sent back to the game device. Typically, the backend system will randomly draw a single result from the fixed pool, which reduces the number of remaining picks in the pool by one (similar to the sale of a scratcher from a pool of scratch tickets). The game device now knows the amount of winnings a player must be awarded by the end of the play sequence about to be started.

As used in this disclosure, a "play sequence" means a sequence of events starting after the game device has a known, predetermined amount of winnings (including 0 winnings) to be displayed, credited, and/or otherwise awarded to a player upon the termination of the sequence and the game device has presented the player with an initial display, has gone through all player interactions, and has arrived at the state of the game device where the aforementioned predetermined amount of winnings is made known to the player; this includes the secondary award sequence needed to bring the total to the amount needed to match the predetermined amount.

"Player interactions" or "player interaction" includes any and all player use of the game that are in accordance with the game being simulated, coupled with the rules of the particular implementation. In one embodiment, there is a poker hand of five card hand shown to the player, and the player interaction consists of choosing which cards to hold, with any cards not held being replaced with new cards. In another embodiment, there is a blackjack game where player interaction consists of hitting until the player holds. The present invention may be used with any gambling style card game where a player has a choice of holding or picking new cards, creating a next step thereby (or ending the game), until the game ends in accordance with the rules of the game. Another example would be a place holding game, where the player is momentarily shown the obverse of a set of cards and then the cards are visually shown as "turned over", the reverse side showing. The goals is that the player must pick cards to turn back over that form a pattern (ex: low-to-high, pairs, etc.); the cards where initially generated to enable a player to generate the already determined winning amount (prize, cash, points, etc.). The player interactions in this case are to choose cards in order and play continues until the player either maximizes play or chooses a wrong card (the match card is used to make up any points a poor player missed, as explained below).

Another embodiment shows a grid, where the player provides a sequence of grid numbers which the gaming machine shows as some type of "hit" or "win" event. Another embodiment shows a series of throws of a set of dice, from which a player chooses to hold or re-throw. All these are examples of "player interactions", the input provided to the game by the player. Other embodiments using skill-based or partial-skill-based games will be readily apparent to one of ordinary skill in the art and having the benefit of the present disclosure.

Returning to FIG. 3, the process continues into diamond 306, where a decision is made on having a "random" bonus prize appear to the player.

The word random is in quotes as the actual implementation of this event may be entirely calculated or may be partially based on a random event. The random aspect being referred to here is from the player's perspective. To make the bonus awards appear to be a true bonus rather than as only as a crutch for poor player choices, there needs to be awards made even when a player makes all the correct plays all the time. Otherwise, a regular player would notice that by making correct play choices they never win a bonus, whereas the really poor poker player next to them gets bonuses on a regular basis. To prevent this, a portion of the total game credit awards (or other form of winnings) won as a result of the fixed-pool drawing must be given to players as a bonus in addition an amount awarded as a result of game play. To accomplish this, a portion of the net amount to be awarded in any given hand is apportioned off to be awarded as a bonus award, so that even if the player plays the game correctly and therefore "wins" the max amount, some will still appear as a bonus. The result is that good game players will see a regular occurrence of bonus awards as well as poor players, preventing the post-play action from appearing as a "poor play fix" which would make the predetermined nature of the play more obvious.

The word "winnings" is used in this disclosure to mean any form or type of winnable item found on any type of game device. This may be game credits, award credits, saveable game states corresponding to some form of value associated with game play, cash, vouchers, tickets, tokens, fixed-value prizes, and any other form of winnable unit that may be used in a game device. A "winning amount" or "winnings amount" is used to mean some number of the winnable units.

Based on an algorithm of choice by the game implementers, the decision is made to either take a portion of the 'predetermined amount from the total and use it as a bonus (only) award or not. Note that if there are no winnings associated with this play, the answer is clearly "No". If there is a winning associated with this play, and if the answer is "Yes" (a bonus-only portion of the predetermined amount is to be set aside), then the "yes" exit is taken to box 312.

The actions corresponding to box 312 include the actions of first determining the amount to be used for the bonus-only award, and deducting that amount from total amount to be awarded. Note that "a portion" of the predetermined amount may include the entire amount. This will be part of the decision made in box 312. In such a case the entire winnings will be presented to the player in the form of a bonus award. In all cases, the amount to be used as a bonus award is deducted from amount to be used in determining the outcome of the impending poker play. Box 312 is left and box 308 is entered.

Returning briefly to diamond 306, if there is to be no bonus-award only portion of the winnings, the "No" exit is taken to box 308.

Continuing with box 308, the game device makes a reverse mapping of the award points into applicable game play, in accordance with the game being played, the bet amounts, etc. The initial display is a display that can be used to reach the desired (by the game device) award amount, if the player makes the right choices. Box 308 is left and box 310 entered, where the player interacts with the game in a manner consistent with the rules of the skill or partial skill game. Box 310 is left and diamond 314 entered.

The decision in diamond 314 is based on the actions the player took. If the player chose the correct actions thereby allowing the game device to create the final award amount needed (corresponding to the pre-selected award amount minus any subtracted award-only bonus amount), then the "Yes" exit would be taken to box 318. Otherwise the "No" exit would be taken to box 316. Proceeding along the path that corresponds to a correct play choice by the player, the "Yes" exit is taken to box 318.

The actions corresponding to box 318 are to show the final amount (e.g., a "hand", if the game were poker, while not changing any of the choices the player made), corresponding to the total award amount minus any bonus-only award amount (if any). The player has "won" an amount corresponding to the final game state and what payline (pay amount as shown on the game glass, usually in a chart on the belly or top box glass) corresponds to that state (e.g., "state" for a poker game is the final set of cards). The game device triggers the post-play sequence in accordance with the primary game, to produce the needed results. The ways this can be done are many and varied, as explained above; in each case, the post-play game must be smoothly integrated into the primary game to keep player interest. The player will be awarded additional points only if some bonus-only points (or other awardable equivalents) were deducted from the total amount to be won in this game play sequence, in which case the player is now awarded those bonus only points. Adding the bonus award winnings (amounts) and the final game state winnings (amounts) always equals the predetermined winnings (amounts) the game device received from a backend machine at the start of play.

Proceeding from box 318, the game is now ready to play again and process continues at box 302 when the player initiates a game play event again. The loop will continue as long as the player is using the game device.

Returning to diamond 314, if the player made less-than-optimal game play choices, which means that no matter what happens the game machine cannot enable a game state with the required win amount, the "No" exit is taken to box 316. A quick example of such a situation can be taken from a poker game. The game is five card draw where the amount to be awarded to a player corresponds to a hand having a full-house. The initial cards shown to the player are two pair and a singleton. The player discards one from each pair. A full house can no longer be made from the remaining cards in the players' hand, corresponding to proceeding to box 316. Similar less-than-optimal play will be found in any game usable with the present invention. Diamond 314 is left and box 316 entered.

The actions corresponding to box 316 include having the game device create a final play (the game ending play or display, depending on the game) that maximizes the amount won (includes winning 0, if that was the predetermined amount). The balance still due the player is then added to the bonus-only amount and the sum awarded through the use of the post-play game. The player has now won the total amount that was to have won in this game or play sequence through the use of both the apparent-skill game and the bonus award. In no case has the player's choices or plays been altered during play. Box 316 is left and the process will continue with box 302 when a game initiation event occurs.

Figure 4:
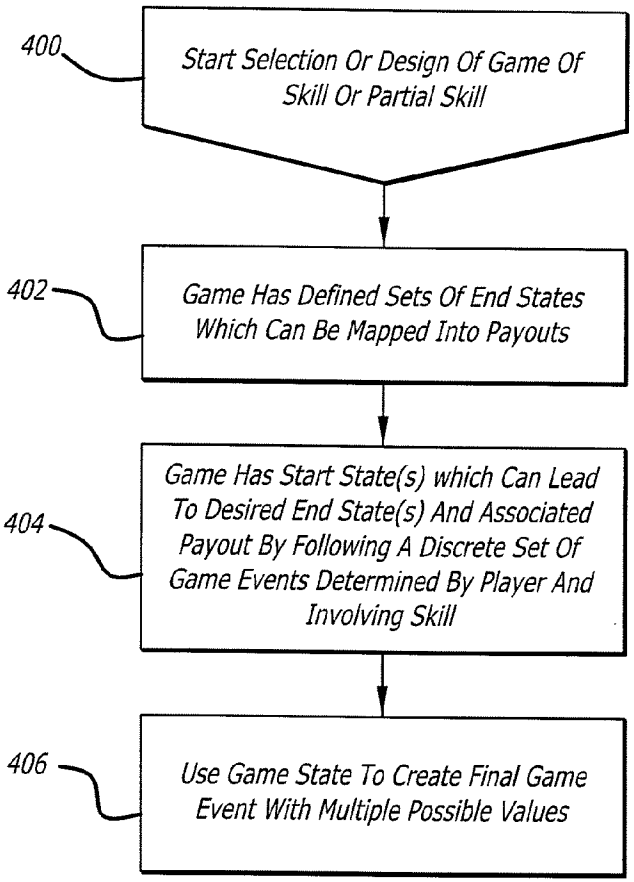
FIG. 4 is a flow diagram showing game requirements for use with the present invention.

FIG. 4 illustrates design parameters for a game usable with the present invention. Starting at box 400, a game involving at least some skill (decisions) by a player is either chosen and evaluated for suitability with a gaming machine of the present invention, or is designed as a new game to have the needed characteristics. Continuing to box 402, the game must have a set of defined end states that can be mapped into a set of payouts. Examples include card games where all possible resulting sets of cards at the end of a game is mapped to some amount of win (note: this is intended to include 0 wins, or card combinations that result in no payout). A typical example of this type of card game is 5-card draw poker. Another example is the grid game described earlier; another example is any type of dice game where one or more dice may beheld by a player; other games suitable for use with the present invention by having any definable set of end states mappable to a payout scheme may be designed as the need arises and all are fully contemplated herein.

Continuing to box 404, the game must have, or the game designers must design, a set of start states that can lead to the end states after players make intervening game events decisions. Typical examples include the 5 card starting hand of 5 card draw poker, the initial throw of the dice for a dice game, the blank (as in, not called out by the player) grids of a grid-based game, etc. Further requirements for the game includes the ability for a player to interact with the game (game events) in one or more steps or choices such that the initial state changes (using the player's input) into one of the final states. The key elements are that a player must have a real choice to make based on some recognized skill, such as holding cards or dice, as part of the one or more game events. Finally, box 406 is entered where the game designers add a final game sequence that is not under the control or influence of the player, but is consistent with the game theme, and can be used to yield an additional win amount that makes up for poor play on the player's part. Examples include the bonus card previously discussed, the extra die throw for dice games, or the squares to select in the grid game.

The game itself, based on a true skill or partial skill game, will be used in the present invention by having the game machine determine a desired end state having the required or calculated payout amount according to the games payouts listed on the player visible portion of the game. The gaming machine then works backwards, using the rules of the game, to generate a start state such that, if the player makes good decisions, will lead to the desired end state. If the player makes poor decisions (or a "bonus" is generated as illustrated in FIG. 3), the gaming machine uses the final event to show an additional award amount (or proper multiplier) so that the overall total is equal to the predetermined amount sent to the gaming machine. This enables the skill or semi skill game to be played with true player input.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing the appearance of true skill or partial-skill game play, when the game is in fact representing a predetermined outcome based on the result of a drawing from a fixed-pool lottery type game. This is accomplished with the use of a post-play game event, made to look like an additional to the base to the player and is in accordance with the primary game (e.g., if the base game is a card game, then the post-play event will be an additional card that relates to the cards already showing in a manner that additional points can be "won" by a player), where the post-play is used to make up any player choice deficiencies when such deficiencies prevent the awarding of the predetermined winnings. This completely avoids the problems found in the prior art (in the prior art a player's bad choices are overridden by the machine). A player's choice is never overridden or changed using the present invention, giving the appearance of real skill or partial-skill game play.

Although the description above contains certain specificity, the described embodiments should not be construed indicating the scope of the invention; the descriptions given are embodiments of the invention which include any game using a combination of a predetermined outcome in conjunction with apparent skill.

What is claimed:

1. A gaming device-enabled gaming system, comprising:

a physical network that enables communication between components in the gaming device-enabled gaming system;

a network host that acts as a game results generator and has a random number generator operably disposed therein, wherein the network host is connected to the physical network, wherein the network host determines and transmits a pre-determined payout amount over the physical network prior to a game play sequence on a gaming device, wherein the payout amount is mapped to a plurality of game end states selected from a universe of game end states; and a plurality of gaming devices in communication with the network host over the physical network, each gaming device having one or more processors, at least one display device, an acceptor of a first physical item associated with a first monetary value that establishes a credit balance on the respective gaming device, and a cashout button actuable to initiate a payout from the credit balance, wherein each gaming device is configured to receive the pre-determined payout amount from the network host over the physical network, to detect a game play event that selects a bet amount drawn on the credit balance, and to initiate at least one apparent game of skill using at least one of the one or more processors and a secondary game regardless of interactions made by the player during the apparent game of skill, the secondary game being independent and separate of the at least one apparent game of skill and having different goals and rules than the at least one apparent game of skill, wherein the gaming system allows a player to interact with the apparent game of skill, and wherein a game outcome for the apparent game of skill and a game outcome for the secondary game each correspond to the pre-determined payout amount received from the network host over the physical network regardless of the interactions made by the player during the apparent game of skill such that a first portion of the pre-determined payout amount is credited to the player upon completion of the apparent game of skill and a second portion of the pre-determined payout amount is credited to the player upon completion of the secondary game, the first and second portions adding up to the pre-determined payout amount received from the network host over the physical network, wherein each gaming device apportions off payout amounts from awards won during the at least one apparent game of skill to reserve a portion of the predetermined payout amount for the secondary game that must be won by the player in the secondary game.

2. The gaming system of claim 1, wherein the apparent game of skill is a dice game having multiple dice, wherein predefined combinations of dice outcomes correspond to winning outcomes.

3. The gaming system of claim 2, wherein the secondary game is a bonus throw of one or more dice.

4. The gaming system of claim 1, wherein the apparent game of skill is a game of blackjack.

5. The gaming system of claim 1, wherein the secondary game is a match bonus card game, wherein the match bonus card is compared to the cards within the blackjack hand, and wherein the match bonus card is a card having the same suit, value, or other predetermined relationship to one card within the blackjack hand.

6. A gaming device-enabled method for presenting an apparent game of skill, the method comprising:

providing a physical network that enables communication between components in the gaming device-enabled gaming system;

providing a network host that acts as a game results generator and has a random number generator operably disposed therein, wherein the network host is connected to the physical network;

providing a plurality of gaming devices in communication with the network host over the physical network, each gaming device comprising: (i) at least one display device, (ii) a plurality of input devices including: (a) an acceptor of a first physical item associated with a first monetary value that establishes a credit balance on the respective gaming device, and (b) a cashout button actuatable to cause an initiation of a payout associated with the credit balance; (iii) one or more gaming device processor, and (iv) at least one gaming device memory device storing a plurality of game play information;

receiving a player request on a gaming device to initiate a gaming session;

detecting a game play event that selects a bet amount drawn on the credit balance;

transmitting the player request to a network host over the physical network, the gaming machine including internal hardware and software for interfacing and communicating wirelessly with the network host and to present game play;

determining and transmitting, via the network host, a predetermined payout amount to the gaming device over the physical network prior to presenting a primary game play sequence on the gaming device;

reserving a portion of the payout amount for a secondary game by apportioning off payout amounts from awards won during the primary game;

mapping the primary game play sequence on the gaming device that corresponds to the payout amount;

presenting the primary game play sequence to the player using at least one of the one or more processors;

receiving player interactions and presenting a final game play sequence and upon completion of the primary game using at least one of the one or more processors;

issuing a primary game award corresponding to the final game play sequence, the primary game award being credited to the player;

presenting the secondary game to the player regardless of the player interactions during play of the primary game, the secondary game being independent and separate from the primary game and having different goals and rules than the primary game; and awarding the player a secondary game award upon completion of the secondary game, the secondary game award being credited to the player, wherein the sum of the primary award and the secondary game award is equal to the pre-determined payout amount received from the network host over the physical network;

wherein each gaming device apportions off payout amounts from awards won during the at least one apparent game of skill to reserve a portion of the predetermined payout amount for the secondary game that must be won by the player in the secondary game.

7. A gaming device-enabled method for presenting an apparent game of skill, the method comprising:

providing a physical network that enables communication between components in the gaming device-enabled gaming system;

providing a network host that acts as a game results generator and has a random number generator operably disposed therein, wherein the network host is connected to the physical network;

providing a plurality of gaming devices in communication with the network host over the physical network, each gaming device comprising: (i) at least one display device, (ii) a plurality of input devices including: (a) an acceptor of a first physical item associated with a first monetary value that establishes a credit balance on the respective gaming device, and (b) a cashout button actuatable to cause an initiation of a payout associated with the credit balance; (iii) one or more gaming device processors, and (iv) at least one gaming device memory device storing a plurality of game play information;

receiving a player request on a game device to initiate a gaming session;

detecting a game play event that selects a bet amount drawn on the credit balance;

transmitting the player request to a network host, the gaming machine including internal hardware and software for interfacing and communicating with the network host and to present game play;

determining and transmitting, via the network host, a predetermined payout amount to the gaming device over the physical network prior to presenting a primary game play sequence on the gaming machine;

reserving a portion of the payout amount for a secondary game that must be won by the player in the secondary game by apportioning off payout amounts from awards won during the primary game;

mapping the primary game play sequence on the gaming device;

presenting the primary game play sequence to the player using at least one of the one or more processors;

receiving player input and presenting a final primary game play sequence based on the player input;

issuing a primary game award corresponding to the final primary game play sequence and upon completion of the primary game, the primary game award being credited to the player;

presenting the secondary game to the player regardless of interactions of the player during the primary game, the secondary game being independent and separate from the primary game and having different rules and goals than the primary game; and awarding the player a secondary game award, the secondary game award being credited to the player, wherein the sum of the primary award and the secondary game award is equal to the pre-determined payout amount received from the network host over the physical network.

8. The method of claim 6, further comprising presenting the secondary game to the player when the portion of the payout amount is reserved for the secondary game.

9. The method of claim 6, wherein the portion of the payout amount reserved for the secondary game is random.

10. The method of claim 7, wherein the portion of the payout amount reserved for the secondary game is random.

11. The method of claim 7, wherein the secondary game is presented to the player when the portion of the payout amount is reserved for the secondary game.

* * * * *